US006213365B1

(12) United States Patent
Stocke et al.

(10) Patent No.: US 6,213,365 B1
(45) Date of Patent: Apr. 10, 2001

(54) PAINTER'S UTILITY BELT

(76) Inventors: David Stocke, 3204 Nielsen Ct., Santa Rosa, CA (US) 95404; Ronald B. Stein, 20565 SW. T.V. Hwy., Beaverton, OR (US) 97006

( * ) Notice: Subject to any disclaimer, the term of this patent is extended or adjusted under 35 U.S.C. 154(b) by 0 days.

(21) Appl. No.: 09/510,485

(22) Filed: Feb. 23, 2000

(51) Int. Cl.[7] ..... A45F 5/00

(52) U.S. Cl. ..... 224/665; 224/223; 224/662; 224/682; 224/683; 224/684; 224/250; 224/904

(58) Field of Search ..... 224/660–665, 224/676, 677, 250, 251, 904, 148.7, 682, 683, 684; 383/113

(56) References Cited

U.S. PATENT DOCUMENTS

| | | | | |
|---|---|---|---|---|
| D. 316,485 | * | 4/1991 | Seber | 224/904 X |
| D. 348,565 | * | 7/1994 | Cummins | 224/663 X |
| 1,597,734 | * | 8/1926 | Sousa, Jr. | 224/663 X |
| 2,710,639 | * | 6/1955 | Farls | 383/113 X |
| 4,127,155 | * | 11/1978 | Hydorn | 383/113 X |
| 4,648,121 | * | 3/1987 | Lowe | 383/113 X |
| 5,240,156 | * | 8/1993 | Sicotte et al. | 224/240 X |
| 5,341,975 | * | 8/1994 | Marinescu | 224/904 X |
| 5,385,281 | | 1/1995 | Byrd . | |
| 5,427,239 | * | 6/1995 | Hunt | 383/113 X |
| 5,489,051 | | 2/1996 | Robinson . | |
| 5,609,283 | * | 3/1997 | Harrison, Jr. | 224/904 X |
| 5,664,712 | * | 9/1997 | Smrt | 224/904 X |
| 5,827,098 | * | 10/1998 | Cunningham | 224/660 X |
| 5,941,438 | * | 8/1999 | Price | 224/660 X |

FOREIGN PATENT DOCUMENTS

| | | | | |
|---|---|---|---|---|
| 8803461 | * | 5/1988 | (WO) | 224/904 |

* cited by examiner

*Primary Examiner*—Gregory M. Vidovich
(74) *Attorney, Agent, or Firm*—Jack Lo

(57) ABSTRACT

A painter's utility belt is comprised of an elongated sash with a widened middle portion embedded with lumbar support inserts. The ends of the sash are releasably attached by a buckle on an adjustable strap. A strip of reinforcing webbing is attached longitudinally on the sash. Loops are formed along the webbing for holding tools, such as a scraper and screwdrivers. A pocket is centered on the sash for holding a sanding block. A pair of vertical loops closed with buckles are attached near the ends of the sash for holding caulking guns, tape, or paint cans. A pair of D-rings are attached to the webbing near the opposite ends for holding a hammer, a rag, etc. A pair of combination pockets are releasably attached to the sash in positions corresponding to the hip positions on the user. The combination pockets are each comprised of a paint pocket lined with a liquid resistant material for holding paint, and a plurality of tool pockets for holding tools. Each combination pocket also includes loops for holding pail hooks, spray gun handles, cell phones, pagers, etc. Thus the belt can hold enough paint and tools for surface preparation as well as paint application work.

11 Claims, 3 Drawing Sheets

PAINTER'S UTILITY BELT

BACKGROUND OF THE INVENTION

1. Field of the Invention

This invention relates generally to utility belts for carrying tools on a person.

2. Prior Art

Utility belts are well known for carrying tools and accessories for various types of work. Some are specifically designed for painting work. A painter's utility belt disclosed in U.S. Pat. No. 5,489,051 to Robinson is comprised of a hip plate attached to a waist strap. A rigid housing is pivotally attached to the hip plate. The housing is provided with holes for receiving tools, and a receptacle for receiving paint. The housing is rigid and extends far out from the hip, so that it may impede arm movements when walking, and it may catch on the steps when climbing a ladder. The paint receptacle can only carry one paint, and it must be cleaned before carrying another paint. The deep interior of the paint receptacle is inconvenient to clean. No lumbar support is provided by the narrow strap for preventing back injury. It does not carry all the equipment necessary for surface preparation and paint application work, so the painter may have to frequently interrupt work to fetch additional tools. Having to fetch missing tools when working on a tall ladder can be particularly inconvenient.

Another painter's utility belt disclosed in U.S. Pat. No. 5,385,281 to Byrd is comprised of an apron attached to a waist strap. Pockets are provided on the apron for holding tools, and smaller straps are attached to the waist strap for holding paint cans and caulking guns. The paint cans are positioned at the front of the painter, so that it may get in the way when going up or down a ladder. Carrying the heavy paint cans at the painter's front causes stress which may injure the back. The horizontal paint can strap may allow a heavy can to slip out and spill paint. It also does not carry enough tools.

OBJECTS OF THE INVENTION

Accordingly, objects of the present painter's utility belt are:

- to carry a plurality of paints in a plurality of interchangeable paint pockets;
- to have paint pockets that are easily cleaned;
- to securely carry a paint can, caulking gun, tape, or other accessories;
- to generally carry all the equipment necessary for surface preparation as well as paint application work;
- to distribute the load of paint and tools evenly on the user;
- to not obstruct arm movements;
- to provide lumbar support for preventing back injury;
- to be adjustable for fitting different waist sizes; and
- to be durable and comfortable.

Further objects of the present invention will become apparent from a consideration of the drawings and ensuing description.

BRIEF SUMMARY OF THE INVENTION

A painter's utility belt is comprised of an elongated sash with a widened middle portion embedded with lumbar support inserts. The ends of the sash are releasably attached by a buckle on an adjustable strap. A strip of reinforcing webbing is attached longitudinally on the sash. Loops are formed along the webbing for holding tools, such as a scraper and screwdrivers. A pocket is centered on the sash for holding a sanding block. A pair of vertical loops closed with buckles are attached near the ends of the sash for holding caulking guns, tape, or paint cans. A pair of D-rings are attached to the webbing near the opposite ends for holding a hammer, a rag, etc. A pair of combination pockets are releasably attached to the sash in positions corresponding to the hip positions on the user. The combination pockets are each comprised of a paint pocket lined with a liquid resistant material for holding paint, and a plurality of tool pockets for holding tools. Each combination pocket also includes loops for holding pail hooks, spray gun handles, cell phones, pagers, etc. Thus the belt can hold enough paint and tools for surface preparation as well as paint application work.

DRAWING REFERENCE NUMERALS

| | |
|---|---|
| 10. Sash | 11. Widened Middle Portion |
| 12. Inserts | 13. First End |
| 14. Second End | 15. Buckle |
| 16. Adjustable Strap | 17. First Portion of Buckle |
| 18. Movable End | 19. Fixed End |
| 20. Second Portion of Buckle | 21. Webbing |
| 22. Loop | 23. Loops |
| 24. Scraper | 25. Screwdrivers |
| 26. Sanding Block Pocket | 27. Sanding Block |
| 28. Logo | 29. Vertical Loops |
| 30. Buckles | 31. Caulking Gun |
| 32. Masking Tape | 33. D-Ring |
| 34. Rag | 35. Combination Pockets |
| 36. Paint Pocket | 37. Liner |
| 38. Tool Pocket | 39. Tool Pocket |
| 40. 5-in-1 Tool | 41. Putty Knife |
| 42. Tool Pocket | 43. Tool Pocket |
| 44. Knife | 45. Vertical Loop |
| 46. Horizontal Loop | 47. Flap |
| 48. Snaps | 49. Snaps |
| 50. Razor Blade Pocket | 51. Razor Blades |
| 52. Paint Brush | 53. Foam Insert |
| 54. Vinyl Backing | |

DETAILED DESCRIPTION OF THE INVENTION

Figure 1:
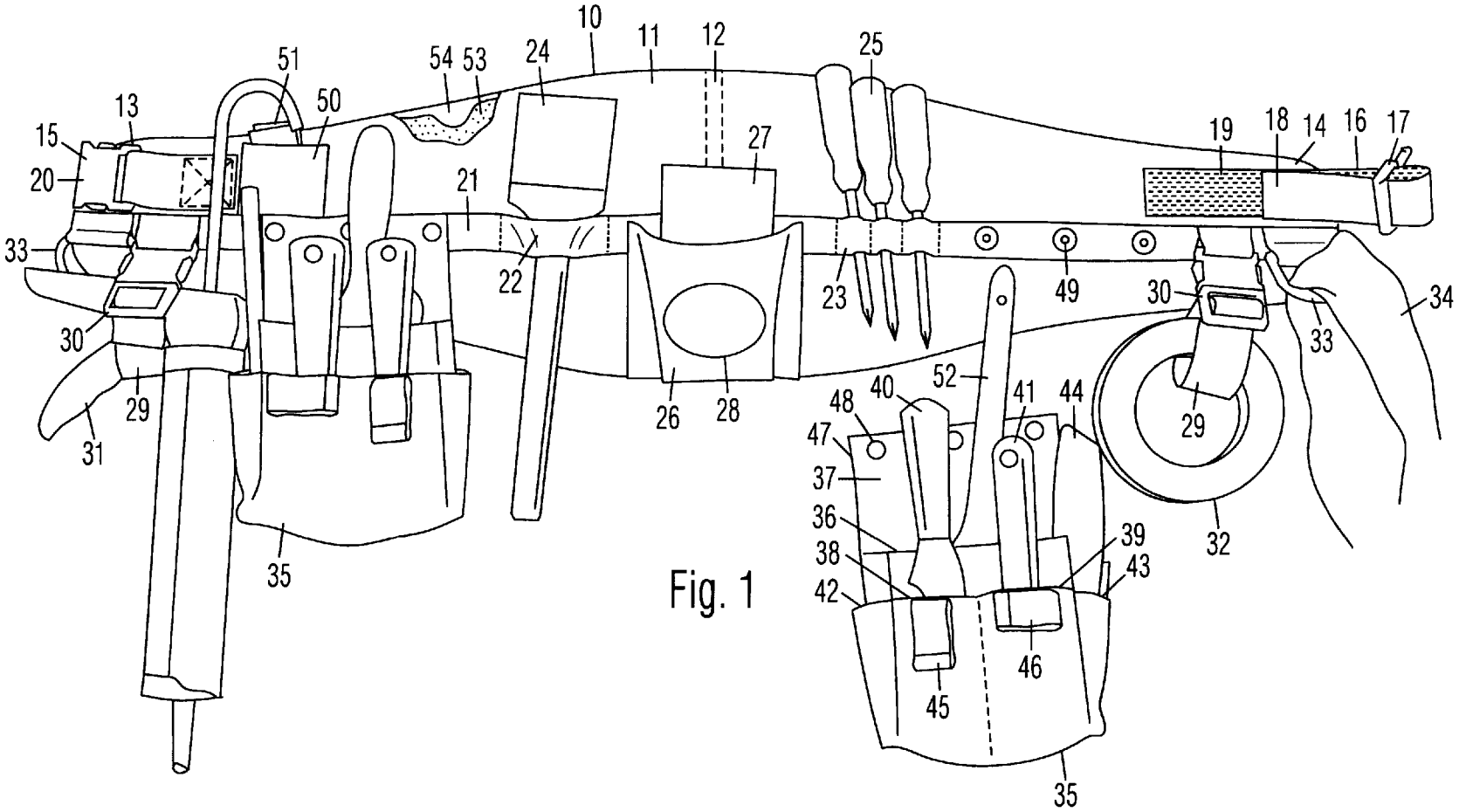
FIG. 1 is a front view of the present painter's utility belt.

FIG. 1:

A preferred embodiment of the present painter's utility belt is shown in a front view in FIG. 1. It is comprised of an elongated sash 10 with a widened middle portion 11 embedded with a plurality of lumbar support inserts 12 (one shown) for preventing back injury. Sash 10 is preferably made of 600×600 dinear fabric. In this partially broken view, a foam insert 53 is arranged within sash 10 for flexibility and comfort, and a vinyl backing 54 is attached to the back of sash 10 for waterproofing.

Narrowed first end 13 and second end 14 of sash 10 are releasably attached by a buckle 15. An adjustable strap 16 is attached to second end 14. Strap 16 is preferably comprised of a hook-and-loop strap looped through a first portion 17 of buckle 15 and attached to itself. The length of strap 16 is changeable by adjusting the position of a movable end 18 on a fixed end 19. A second portion 20 of buckle 15 is attached to first end 13 of sash 10 by a short strap attached to the sash by a box stitch for strength.

A strip of reinforcing webbing 21 is attached longitudinally on sash 10, and preferably extends the entire length thereof for improving durability and strength for supporting heavy equipment. Webbing 21 is preferably a polypropylene webbing. Loops 22 and 23 are formed along webbing 21 for holding equipment, such as a scraper 24 and screwdrivers 25. A sanding block pocket 26 is centered on sash 10 at middle portion 11 for holding equipment, such as a sanding block 27. A logo 28 is arranged on pocket 26.

A pair of vertical loops 29 with detachable ends connected with buckles 30 are attached near the ends of sash 10 for holding equipment, such as a caulking gun 31, a roll of masking tape 32, or paint cans (not shown), which are all very important for surface preparation. Loops 29 are preferably attached to webbing 21 for strength. A pair of D-rings 33 are attached to webbing 21 near first end 13 and second end 14 for holding equipment, such as a rag 34 or hammer (not shown). A razor blade pocket 50 is provided near an upper edge of sash 10 for holding equipment, such as razor blades 51.

A pair of combination pockets 35 are releasably attached to sash 10 inward from ends 13 and 14 about a third of the length of sash 10. One combination pocket 35 is shown detached from sash 10. They are each comprised of a paint pocket 36 lined with a liquid resistant liner 37 for holding paint and a paint brush 52; a pair of tool pockets 38 and 39 in front of paint pocket 36 for holding tools, such as a 5-in-1 tool 40 and a putty knife 41; a pair of side tool pockets 42 and 43 on the sides of paint pocket 36 for holding additional tools, such as a knife 44, window scraper, or sprayer tips (not shown); a vertical loop 45 for holding equipment, such as pail hooks, spray gum handle, pager (not shown); and a horizontal loop 46 for holding equipment with a belt clip, such as a cell phone or pager (not shown). A flap 47 extends upward from the back of paint pocket 36, and is also lined with liquid resistant liner 37. Snaps 48 on flap 47 are arranged to mate with snaps 49 on sash 10. Snaps 49 are preferably attached along webbing 21 for strength. Each paint pocket 36 is preferably large enough to hold half a quart of paint.

Figure 2:
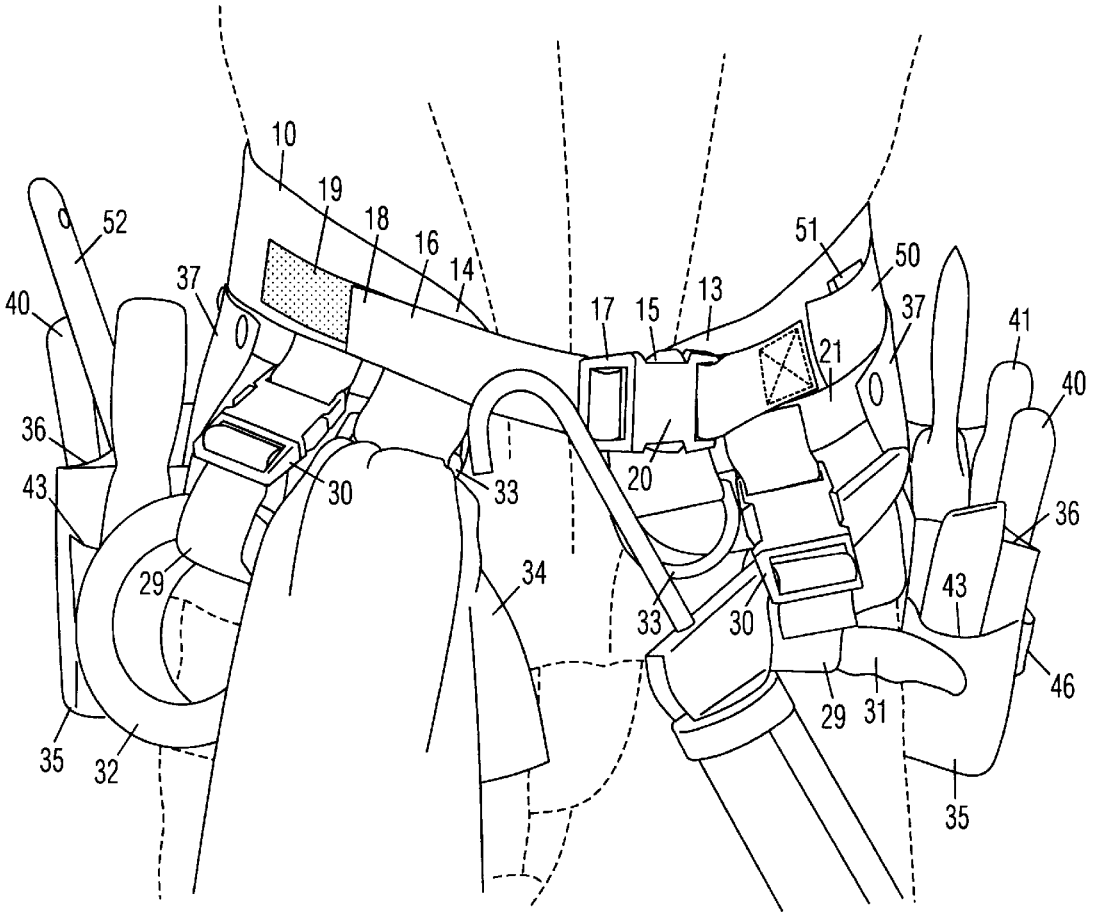
FIG. 2 is a front view of the utility belt on a user.
Figure 3:
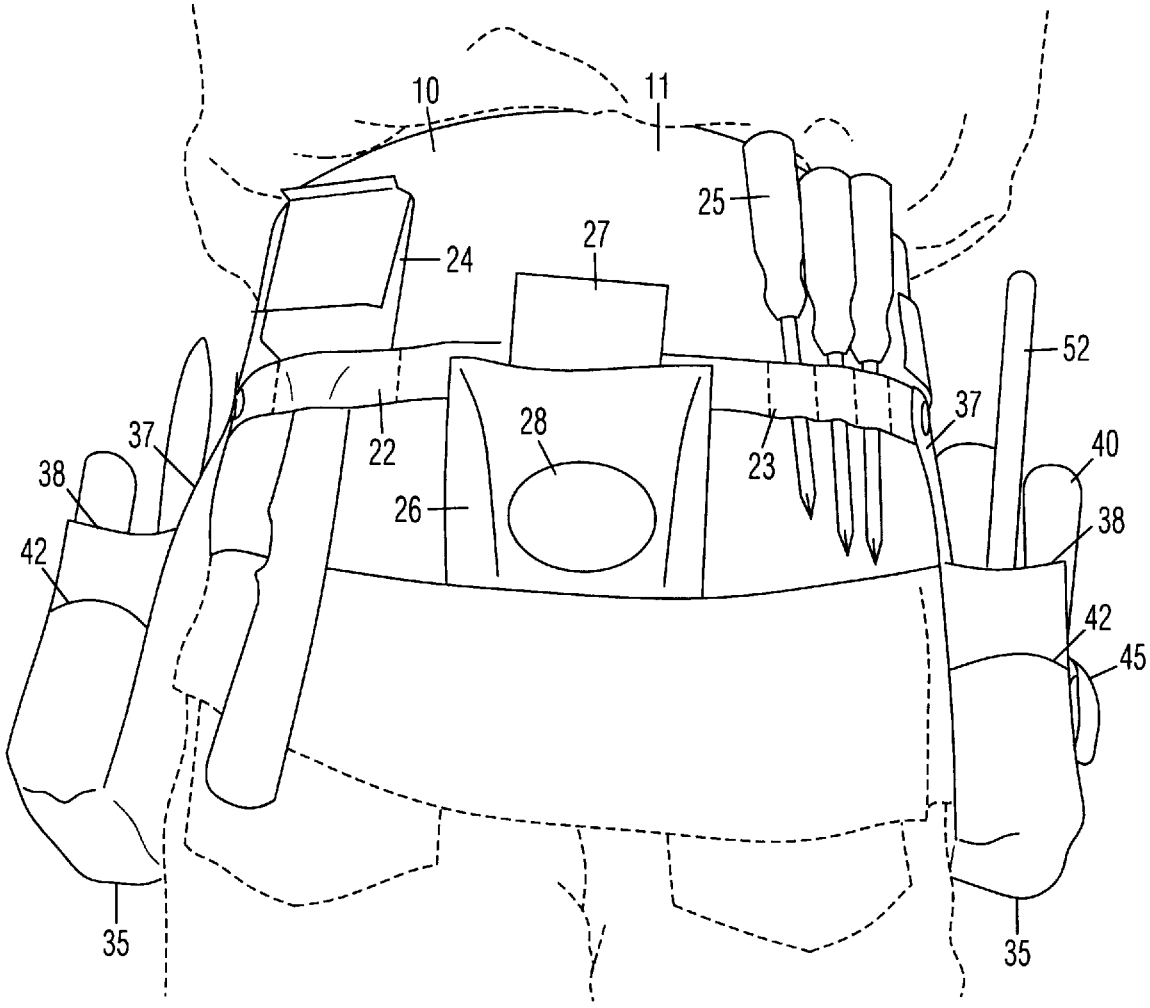
FIG. 3 is a rear view of the utility belt on a user.

FIGS. 2–3:

The painter's utility belt is shown worn on a user in a front view in FIG. 2 and a rear view in FIG. 3. Sash 10 is wrapped around a waist of the user, and ends 13 and 14 are connected by buckle 15 at the front of the user. Adjustable strap 16 is adjusted to provide a snug fit across a range of waist sizes. Sash 10 may be made in a variety of sizes.

At the front, vertical loops 29 hold tape 32 and caulking gun 31 within easy reach. Each vertical loop 29 can also hold a paint can (not shown) by looping through its handle. The vertical orientation of loops 29 ensure that the equipment cannot slip out and fall off. Razor blade pocket 50 and D-ring 33 respectively position razor blades 51 and rag 34 or hammer (not shown) within easy reach at the front of the user.

At the sides, combination pockets 35 position paint and various tools within easy reach at the hips of the user, but they have a low enough profile to avoid obstructing arm movements, and to keep tool handles below the belt line to avoid poking the user. They can hold up to two different paints that are poured into paint pockets 36. Up to four different paints can be carried: two in paint pockets 36, and two in cans (not shown) hung on vertical loops 29. Combination pockets 35 can be easily interchanged with spare combination pockets to make changing paint very easy. Liners 37 prevent paint seepage and leakage, and make cleaning a breeze. Paint pockets 36 can be inverted for even easier cleaning.

At the rear, sanding block pocket 26 positions sanding block 27 in a centered location within convenient reach. Loops 22 and 23 position the longer tools, such as scraper 24 and screwdrivers 25, on the wider part of sash 10 to avoid obstructing the user's movements. The belt is generally symmetrical for distributing the load of paint and tools evenly on the user for comfort.

SUMMARY AND SCOPE

Accordingly,the present painter's utility belt carries a plurality of paints in a plurality of interchangeable paint pockets. It has paint pockets that are easily cleaned. It securely carries paint cans, caulking guns, tapes, 5-in-1 tools, brushes, razor blades, and other equipment. The pockets and loops can carry any suitable equipment, so that they are not limited to carrying only the equipment shown. It generally carries all the equipment necessary for surface preparation as well as paint application work, so that the user does not have to frequently go fetch additional equipment, which is particularly convenient when working high up on a ladder. It distributes the load of paint and tools evenly on the user. It does not obstruct arm movements. It provides lumbar support for preventing back injury. It is also adjustable for fitting different waist sizes.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

We claim:

1. A painter's utility belt, comprising:

an elongated sash for wrapping around a waist of a user;

a strip of webbing extending generally across an entire length of said sash;

a plurality of first snaps attached to said webbing for durability;

a pair of combination pockets releasably attached to said snaps on said sash for easy cleaning and interchangeability, wherein each of said combination pockets is comprised of:

a vertical flap with a plurality of second snaps attached adjacent a top end thereof and detachably connected to said first snaps on said sash, wherein said flap is lined with a liquid resistant liner for preventing paint from splashing onto the user;

a paint pocket attached to a lower end of said flap and vertically aligned with said flap, wherein said paint pocket is suspended completely below said sash for being within easy reach, said paint pocket is also lined with said liquid resistant liner for holding said paint, said paint pocket has a top opening for holding a paint brush, said paint pocket is invertible for easy cleaning;

a pair of front tool pockets in front of said paint pocket respectively adapted to hold a 3-in-1 tool and a putty knife;

a pair of side tool pockets on opposite sides of said paint pocket respectively adapted to hold a knife and a window scraper;

a pair of loops on said front tool pockets respectively adapted to hold equipment;

wherein said flap is adapted to position items carried in said paint pocket, said front tool pockets, and said side tool pockets substantially below the waist of the user for easy reach and to avoid poking the user;

wherein said combination pockets are adapted to carry many essential painter's tools and equipment for greater efficiency.

2. The painter's utility belt of claim 1, wherein said sash is made of a 600×600 dinear fabric.

3. The painter's utility belt of claim 1, wherein said belt is generally symmetrical about a mid point thereof for even load distribution.

4. The painter's utility belt of claim 1, further including a sanding block pocket generally attached to a mid point on said sash for holding a sanding block on a back of the user for easy reach.

5. The painter's utility belt of claim 1, further including a foam insert arranged within said sash for flexibility and comfort.

6. The painter's utility belt of claim 1, further including a vinyl backing on a back of said sash for waterproofing.

7. A painter's utility belt, comprising:

an elongated sash for wrapping around a waist of a user, said sash including a widened middle portion, a narrowed first end, and a narrowed second end, said widened middle portion for supporting a back of said user, said first end and said second end being detachably connected together at a front of said user, said first end and said second end being narrowed for allowing said user to bend forward;

a plurality of lumbar support inserts in said middle portion of said sash for helping prevent back injury;

a buckle attached to said first end of said sash;

an adjustable length strap extending from said second end of said sash and detachably connected to said buckle;

a strip of reinforcing webbing extending generally along an entire length of said sash for strength and durability;

a plurality of loops arranged along said webbing for holding tools;

a sanding block pocket attached to said middle portion of said sash for holding a sanding block;

a pair of vertical loops with detachable ends connected together with buckles, said vertical loops respectively attached near said first end and said second end of said sash for holding said tools, said vertical loops being attached to said webbing for strength;

a pair of D-rings respectively attached near said first end and said second end of said sash for holding said tools, said rings being attached to said webbing for strength;

a razor blade pocket attached to said sash for holding razor blades; and a pair of combination pockets releasably attached to said sash, said combination pockets each comprising:

a paint pocket lined with a liquid resistant liner for holding paint;

a flap extending upwardly from a back of said paint pocket, said flap also lined with said liquid resistant liner;

a plurality of snaps on said flap connected to a plurality of mating snaps on said sash, said mating snaps being attached to said webbing for strength;

a pair of front tool pockets in front of said paint pocket for holding said tools;

a pair of side tool pockets on opposite sides of said paint pocket for holding said tools;

a vertical loop on a front of said front tool pockets for holding said tools; and a horizontal loop on a front of said front tool pockets for holding said tools.

8. The painter's utility belt of claim 7, wherein said sash is made of a 600×600 dinear fabric.

9. The painter's utility belt of claim 7, wherein said strap is comprised of a hook-and-loop strap which is looped back on itself for being adjusted in length.

10. The painter's utility belt of claim 7, further including a foam insert arranged within said sash for flexibility and comfort.

11. The painter's utility belt of claim 7, further including a vinyl backing on a back of said sash for waterproofing.

* * * * *